US009396919B2

(12) United States Patent
Makarov et al.

(10) Patent No.: US 9,396,919 B2
(45) Date of Patent: Jul. 19, 2016

(54) COLLISION CELL

(71) Applicant: Thermo Fisher Scientific (Bremen) GmbH, Bremen (DE)

(72) Inventors: Alexander Makarov, Bremen (DE); Eduard V. Denisov, Bremen (DE); Wilko Balschun, Bremen (DE); Dirk Nolting, Bremen (DE); Jens Griep-Raming, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/005,881

(22) Filed: Jan. 25, 2016

(65) Prior Publication Data

US 2016/0141167 A1 May 19, 2016

Related U.S. Application Data

(63) Continuation of application No. 14/834,291, filed on Aug. 24, 2015, now Pat. No. 9,245,723, which is a continuation of application No. 14/625,439, filed on Feb. 18, 2015, now Pat. No. 9,117,639, which is a (Continued)

(30) Foreign Application Priority Data

Jun. 3, 2008 (GB) ..... 0810125.5

(51) Int. Cl.
*H01J 49/04* (2006.01)
*H01J 49/00* (2006.01)

(52) U.S. Cl.
CPC ..... *H01J 49/0422* (2013.01); *H01J 49/0031* (2013.01)

(58) Field of Classification Search
USPC ..... 250/282, 281, 292
See application file for complete search history.

(56) References Cited

U.S. PATENT DOCUMENTS

| | | | |
|---|---|---|---|
| 5,847,386 | A | 12/1998 | Thomson et al. |
| 6,559,441 | B2 | 5/2003 | Clemmer |
| 7,067,802 | B1 | 6/2006 | Kovtoun |
| 7,077,944 | B2 | 7/2006 | Clemmer |
| 7,145,139 | B2 | 12/2006 | Syka |
| 7,196,324 | B2 | 3/2007 | Verentchikov |
| 8,598,518 | B2 | 12/2013 | Green et al. |
| 8,633,435 | B2 | 1/2014 | Kenny et al. |
| 2003/0001085 | A1 | 1/2003 | Bateman et al. |

(Continued)

FOREIGN PATENT DOCUMENTS

| | | |
|---|---|---|
| DE | 20310260 U1 | 1/2004 |
| DE | 69722717 T2 | 4/2004 |

(Continued)

*Primary Examiner* — Kiet T Nguyen
(74) *Attorney, Agent, or Firm* — Charles B. Katz

(57) ABSTRACT

A method of operating a gas-filled collision cell in a mass spectrometer is provided. The collision cell has a longitudinal axis. Ions are caused to enter the collision cell. A trapping field is generated within the collision cell so as to trap the ions within a trapping volume of the collision cell, the trapping volume being defined by the trapping field and extending along the longitudinal axis. Trapped ions are processed in the collision cell and a DC potential gradient is provided, using an electrode arrangement, resulting in a non-zero electric field at all points along the axial length of the trapping volume so as to cause processed ions to exit the collision cell. The electric field along the axial length of the trapping volume has a standard deviation that is no greater than its mean value.

12 Claims, 5 Drawing Sheets

Related U.S. Application Data continuation of application No. 14/456,988, filed on Aug. 11, 2014, now Pat. No. 8,963,074, which is a continuation of application No. 14/081,990, filed on Nov. 15, 2013, now Pat. No. 8,803,082, which is a continuation of application No. 13/617,873, filed on Sep. 14, 2012, now Pat. No. 8,586,914, which is a continuation of application No. 12/996,226, filed as application No. PCT/GB2009/001389 on Jun. 3, 2009, now Pat. No. 8,278,618.

(56) References Cited

U.S. PATENT DOCUMENTS

| | | | | |
|---|---|---|---|---|
| 2005/0098719 | A1 | 5/2005 | Thomson | |
| 2010/0237238 | A1 | 9/2010 | Franzen | |
| 2010/0252730 | A1 | 10/2010 | Green et al. | |
| 2010/0294923 | A1* | 11/2010 | Kenny | H01J 49/0045 250/282 |
| 2011/0186724 | A1 | 8/2011 | Nolting et al. | |
| 2014/0034825 | A1 | 2/2014 | Newton | |
| 2014/0158878 | A1* | 6/2014 | Green | H01J 49/065 250/282 |

FOREIGN PATENT DOCUMENTS

| | | | |
|---|---|---|---|
| EP | 0817239 | A1 | 1/1998 |
| EP | 1901332 | A1 | 3/2008 |
| EP | 1364388 | B1 | 10/2011 |
| GB | 2389704 | | 12/2003 |
| GB | 2392301 | | 2/2004 |
| GB | 2421843 | A | 7/2006 |
| GB | 2439814 | A | 1/2008 |
| GB | 2435714 | B | 6/2010 |
| WO | WO 2005/074004 | A2 | 8/2005 |
| WO | WO 2006/103412 | A2 | 5/2006 |
| WO | WO 2008/059255 | A2 | 5/2008 |

* cited by examiner

COLLISION CELL

CROSS REFERENCE TO RELATED APPLICATIONS

This application is a Continuation of U.S. application Ser. No. 14/834,291 filed Aug. 24, 2015, entitled "Collision Cell", which is a continuation of U.S. application Ser. No. 14/625,439 filed Feb. 18, 2015, now U.S. Pat. No. 9,117,639, which is a continuation of U.S. application Ser. No. 14/456,988 filed Aug. 11, 2014, now U.S. Pat. No. 8,963,074, which is a continuation of U.S. application Ser. No. 14/081,990 filed Nov. 15, 2013, now U.S. Pat. No. 8,803,082, which is a continuation of U.S. application Ser. No. 13/617,873 filed Sep. 14, 2012, now U.S. Pat. No. 8,586,914, which is a Continuation of U.S. application Ser. No. 12/996,226 filed Dec. 3, 2010, now U.S. Pat. No. 8,278,618, which is the United States National Stage Application, under 35 U.S.C. 371, of International Application PCT/GB2009/001389, filed Jun. 3, 2009, which applications are incorporated herein by reference in their entireties.

TECHNICAL FIELD OF THE INVENTION

The invention relates to a collision cell and a method of operating a collision cell in a mass spectrometer. It also relates to a method of effecting electron transfer dissociation using a collision cell.

BACKGROUND TO THE INVENTION

In a mass spectrometer, a collision cell can be used for a variety of purposes. For instance, a collision cell can be used to reduce the thermal energy of ions, to permit more accurate mass analysis thereby.

Collision cells can also be used in tandem mass spectrometry. In such techniques, structural elucidation of ionised molecules is performed by using a mass spectrum produced in a first mass analysis step, then selecting a desired precursor ion or ions from the mass spectrum, ejecting the chosen precursor ions (or ion) to a collision cell where they are fragmented, and transporting the ions, including the fragmented ions, to a mass analyser for a second mass analysis step in which a mass spectrum of the fragment ions is collected. The method can be extended to provide one or more further stages of fragmentation (i.e. fragmentation of fragment ions and so on). This is typically referred to as $MS^n$, with n denoting the number of generations of ions. Thus $MS^2$ corresponds to tandem mass spectrometry.

An instrument that is suitable for a wide array of mass spectrometry and $MS^n$ experiments is described in WO-A-2006/103412. This instrument has a longitudinal axis, along which is located an ion source and a reaction cell. Ions generated by the source travel along the axis in a forwards direction and enter the reaction cell, where they are fragmented. The fragmented ions are then ejected from the collision cell in a backwards direction along the longitudinal axis. They can then be received in an intermediate ion trap, from where they can be ejected to an off-axis mass analyser. Such an arrangement, together with a reagent ion source can be used for Electron Transfer Dissociation (ETD). A similar, but slightly different design of mass spectrometer is shown in U.S. Pat. No. 7,297,939.

Collision cells typically comprise electrodes for trapping ions and are pressurised and filled with gas to cause collisions. As a result, even if only fragmentation of ions is desired, collisional damping of the ion motion will nevertheless occur, such that the temperature of the ions is significantly reduced. Ejection of the ions in a backwards direction is therefore problematic. As explained in WO-A-2006/103412, ejection of the fragmented ions from the collision cell back along the longitudinal axis can be achieved by applying an accelerating DC potential gradient across the end-electrodes of the collision cell.

An alternative arrangement is described in GB-2389704, in which a collision cell comprises a plurality of ring-shaped electrodes. Ions are ejected by providing a DC axial gradient to these electrodes, preferably in a stepped way between the electrodes.

However, it has been found for existing arrangements that provide an axial gradient that the rate at which ions are ejected from the collision cell once trapped, or in the reverse direction, is much lower than would be expected.

SUMMARY OF THE INVENTION

Against this background, the present invention provides a method of operating a gas-filled collision cell in a mass spectrometer, the collision cell having a longitudinal axis, the method comprising: causing ions to enter the collision cell; generating a trapping field within the collision cell so as to trap the ions within a trapping volume of the collision cell, the trapping volume being defined by the trapping field and extending along the longitudinal axis; processing trapped ions in the collision cell; and providing a DC potential gradient resulting in a non-zero electric field at all points along the axial length of the trapping volume so as to cause processed ions to exit the collision cell. The electric field along the axial length of the trapping volume has a standard deviation that is no greater than its mean value.

The inventors of this invention have discovered that the low ejection rate of ions from the collision cell in the reverse direction results from two main factors. Although descriptions of existing collision cells indicate that a linear DC potential gradient is applied along the whole of the trapping volume axial length, this is actually a highly simplified representation of the potential distribution.

For example, when the accelerating potential is applied to the end-electrodes of the collision cell, the influence of the electric field generated thereby in the axial centre of the cell is small (practically, non-existent). When the DC potential gradient is provided by multiple electrodes along the axial length of the trapping volume, the electric field is typically much stronger in the immediate vicinity of an electrode and much weaker in the regions in between electrodes. In other words, the potential gradient (and thus the electric field) is variable to a large degree.

Ions located in-between two electrodes undergo numerous collisions with neutrals, resulting in a reduction in their thermal energy. The influence of the electric field may be to all practical intents zero in this region, so these ions experience a "random walk" due to their thermal energy alone until they reach a region of the collision cell where the electric field is stronger. This is true at surprisingly low gas pressures. Based on this understanding alone, an ion would be expected to exit the collision cell in around 5 ms in a multipole of length 100 mm and a pressure of approximately 0.05 Pa.

However, the inventors have further discovered that the actual ion return rate is far below this expectation value. Moreover, it has also been found the return rate varies between supposedly identical collision cells. The reason for these disparities is related to small manufacturing variations, like surface inhomogeneities, multipole rod holding facilities, materials changes by welding, straightness or parallelism issues, etc. These cause unintended, accidental traps (potential "pockets") to be formed in the collision cell. Higher energy ions tend to be unaffected by such relatively shallow pockets. Ions of lower energy (for example, at thermal energies), however, are affected by these potential pockets, resulting in ions becoming trapped in these for periods of time before they can penetrate the potential barriers presented and escape.

The unwanted trapping of ions in field irregularities is mass dependent and more pronounced for ions with higher mass. This also means that, at a given mass to charge ratio, ions of higher charge (and thus higher mass) tend to be involuntarily trapped in the collision cell more easily. As a result, the invention provides particular improvement in the analysis of higher oligomers and polymers, such as for example peptides with more than 20 amino acids or proteins. This mechanism further reduces the ion ejection rate.

Simply increasing the magnitude of the potential gradient across the cell will address the above problems. However, it will cause further problems, in that it will increase the electric field experienced by all ions in the collision cell. Consequently, those ions which would experience an electric field generated using the electrodes in any case and which are not caught in an unintended potential pocket will be accelerated out of the trap at a much greater rate. It would therefore be more difficult to trap these ions emerging from the collision cell in a downstream ion trap. Such earlier approaches have not recognised these problems, and therefore do not consider the magnitude and uniformity of the electric field along the whole length of the trapping region.

In contrast, the present invention applies a potential gradient such that the electric field along substantially the whole length of the trapping volume is non-zero. Moreover, the applied potential gradient is substantially uniform, in that the standard deviation of the potential distribution along the axial length is no greater than the mean of this distribution. This ensures that all of the ions are smoothly ejected from the ion trap at a faster rate than previously achievable, without increasing the energy of most of the ions beyond an acceptable level that will prevent them from being subsequently trapped.

Preferably, the potential gradient results in an electric field of no less than 1 V/m at any point along the axial length of the trapping volume. More preferably, the potential gradient results in an electric field of no less than 3 V/m at any point along the axial length of the trapping volume. Measurements in different systems have shown that the voltage errors due to surface charges or imperfections ("patch potentials") are typically in the range of 20 mV to 50 mV, although they can extend as high as 100 mV and exceptionally 200 mV. Similar errors in the homogeneity of the potential along the axis of an ion guide can occur due to formation of a sequence of three-dimensional ion traps in stacked ring ion guides. Depending on the RF-drive properties, the effective potential of such three-dimensional traps can be in the order of up to 100 mV or more for typical ring distances of 2 to 5 mm. Advantageously, the potential gradient results in an electric field of no less than 10 V/m at any point along the axial length of the trapping volume. This results in the residual potential wells to be of a depth smaller than $k \cdot T$, where k is the Boltzmann constant and T is the temperature (0.03 eV at room temperature), such that ions exit the ion guide promptly and at approximately the same time. Beneficially, the potential gradient results in any potential wells along the length of the trapping region having a depth of less than 0.03 eV.

In the preferred embodiment, the electric field along the axial length of the trapping volume has a standard deviation that is no greater than two-thirds of its mean value. More preferably, the electric field along the axial length of the trapping volume has a standard deviation that is no greater than half (50%) of its mean value. Optionally, the electric field along the axial length of the trapping volume has a standard deviation that is no greater than one-third (33%) or one-quarter (25%) of its mean value. The uniformity of the potential gradient is a significant advantage. Where the electric field tends towards zero, ions may become caught in a potential well. Irregularities in the potential gradient result in a broadening of the energy distribution of ejected ions and increasing the magnitude of the potential gradient increases the difficulty in trapping ejected ions.

Optionally, the potential gradient results in an electric field of no greater than 5 V/mm at any point along the axial length of the trapping volume. More preferably, the potential gradient results in an electric field of no greater than 1 V/mm at any point along the axial length of the trapping volume. Increasing the magnitude of the accelerating electric field makes it more difficult to trap ejected ions downstream. Hence, by so limiting the electric field, ions ejected from the collision cell can advantageously be directed for mass analysis or further processing.

Optionally, the method further comprises directing the ions ejected from the collision cell into a target ion trap. In some applications, it is desirable to maintain a low pressure in the target ion trap. This is especially the case when ions are to be radially ejected from the ion trap for measurement in a high resolution mass analyzer, such as an Orbitrap™, or a Time-of-Flight mass spectrometer, or a multi-reflection or multi-turn Time-of-Flight mass spectrometer.

Preferably, the product of the pressure of gas within the target ion trap (P) and the axial length of the target ion trap trapping volume (l) is no greater than 0.004 mbar·cm. More preferably, the product of P and l is no greater than 0.002 or 0.0015 or 0.001 or 0.0005 or 0.00025 or 0.0002 mbar·cm. Operating the collision cell at low pressures is maintainable when ejection is achieved using a uniform axial DC potential gradient. For example, the pressure in the cell may be less than 0.001 mbar, and typically less than 0.0005 mbar at a length of approx. 2 to 3 cm (giving a typical product of P and l of less than 0.0015 mbar·cm).

Preferably, the product of the pressure of gas within the collision cell and the axial length of the collision cell trapping volume is 10 to 100 times higher than that of the ion trap.

Advantageously, the method further comprises providing a DC potential gradient using the electrode arrangement at the same time as the step of causing ions to enter the collision cell. A DC potential gradient is optionally additionally provided during the steps of: generating a trapping field; and processing trapped ions in the collision cell. The trapping field may provided by an electrode arrangement to which is applied a plurality of barrier potentials. The application of a DC potential gradient along the length of the trapping volume does not have a significant contribution in this case and it may be advantageous to maintain the potential gradient all of the time that the collision cell is being used.

Preferably, the direction of the DC potential gradient provided during the step of causing ions to enter the collision cell is the same as the direction of the DC potential gradient that causes processed ions to exit the collision cell. The direction may optionally also remain the same during the steps of: generating a trapping field; and processing trapped ions in the collision cell.

Beneficially, the magnitude of the DC potential gradient provided during the step of causing ions to enter the collision cell is the same as the direction of the DC potential gradient that causes processed ions to exit the collision cell. The magnitude may optionally also remain the same during the steps of: generating a trapping field; and processing trapped ions in the collision cell. There is no thus need to turn off the axial DC potential gradient, even when ions are being injected into or processed within the collision cell.

The trapping field is preferably generated using a plurality of rod electrodes. The trapping field may alternatively be generated using a plurality of stacked ring electrodes or a plurality of stacked plate electrodes. Additionally or alternatively, the electrode arrangement (to which the DC potential gradient is applied) comprises a plurality of rod electrodes. These rod electrodes are elongated.

The method preferably further comprises: generating ions in an ion source; and causing generated ions to enter and then to exit an ion store, the ions exiting the ion store travelling towards the collision cell. If the ion store is a first ion store, the method may optionally further comprise: storing ions generated in the ion source in a second ion store using automatic gain control; and directing the stored ions towards the first ion store. The second ion store can therefore be used for preparing the ions.

In the preferred embodiment, the method further comprises mass filtering the generated ions, before directing the ions towards the collision cell. The step of mass filtering may take place in the first ion store, second ion store, or in a separate mass filter.

The step of providing a potential gradient preferably causes the ions to move towards the ion store. Then, the method may further comprise, before the ions enter the ion store for a second time, adjusting the relative potentials of the collision cell and the ion store, such that the energy of a proportion of the ions entering the ion store for the second time is no greater than 10 eV. In the preferred embodiment, the potential gradient is provided continuously. Moreover, the method further comprises: causing the ions to enter the ion store for a second time. The ion store may advantageously be identical to the target ion trap described above.

Optionally, the energy of a proportion of the ions entering the ion store for the second time is no greater than 5 eV or 2 eV or 1 eV or 0.5 eV or 0.2 eV or 0.1 eV. The proportion of the ions to which this condition applies is preferably 66%, but optionally may be 50%, 75% or 90% or 95%. This adjustment in potential difference between the collision cell and the ion store advantageously allows the energy distribution of the ions received at the ion store to be set in a desired range, such that the received ions are trapped in the ion store. Embodiments of the invention can be operated such that ions do not need cooling before being processed further, for example by detection in a high resolution mass analyzer. Cooling may require a significant time.

Optionally, the method further comprises adjusting the potential gradient based upon the charge of the processed ions. In particular, the voltage gradient can be made higher for higher charges of the ions at a given mass-to-charge ratio and lower for lower charges of the ions at a lower mass-to-charge ratio. Advantageously, the method further comprises maintaining a pressure inside the collision cell which is substantially greater than that of the ion store.

In a first implementation of the present invention, the collision cell has an ion entrance and the step of causing ions to enter the collision cell occurs through the ion entrance in a forward direction. Then, the step of providing a potential gradient comprises causing processed ions to exit the collision cell in a reverse direction generally opposed to the said forward direction. The ions preferably exit the collision cell in the reverse direction through the ion entrance. Alternatively, the ions may exit the collision cell in the reverse direction through another aperture.

In this implementation, when ions are generated in an ion source and caused to enter and then exit an ion store and then travel towards the collision cell, the processed ions may optionally be caused to enter the ion store once more along a first axis as they travel in the reverse direction. In this way, the processed ions can be stored for further analysis.

In the first implementation, the method may further comprise ejecting at least some of the processed ions from the ion store into a mass analyser along a second axis, the second axis being different from the said first axis. Alternatively, mass analysis of the ions may be performed in the ion store. For example, this may be possible where the ion store is a linear ion trap. This avoids the need for an ion store and separate mass analyser.

Optionally, the step of processing comprises fragmentation, and the processed ions comprise fragmented ions. The step of processing may additionally or alternatively comprise cooling.

Moreover, in the first implementation, the method may optionally comprise: ejecting the trapped ions from the collision cell in a direction that is not the reverse direction; and causing the ejected ions to enter the collision cell again, before exiting the collision cell in the reverse direction. The ions re-entering the collision cell can inadvertently become trapped in the accidental potential pockets. The non-zero electric field at all points along the axial length of the trapping volume causes these ions to be ejected from the collision cell in the reverse direction. Optionally, the ions are ejected from the collision cell in the forward direction, and the ejected ions are caused to enter the collision cell again, by causing them ions to travel in the reverse direction.

In this implementation, the ions may exit the collision cell in the reverse direction by travelling through the ion entrance of the collision cell. Alternatively, the collision cell may comprise a second ion aperture, through which the ions exit the collision cell in the reverse direction.

In a second implementation, the method may further comprise: generating at least one discrete pulse of a first set of ions, having a first polarity, the step of causing ions to enter the collision cell comprising directing the pulse or pulses into the collision cell and the step of providing a potential gradient resulting in the first set of ions being ejected from the collision cell and into a separate ion trap; and effecting an electron transfer dissociation interaction between the ions of the first set in the separate ion trap with ions of a second set, the ions of the second set having a second, opposite polarity to those of the said first set.

The inventors have discovered that the throughput of transmitted pulsed ions through a collision cell is limited. This is a consequence of the lack of driving force experienced by intermittent beams of ions travelling through the collision cell.

In a typical instrument, a multipole ion guide receives a continuous ion beam from an ion source, such that the "later" ions force "earlier" ions to travel through. However, for Electron Transfer Dissociation (ETD), it is advantageous to switch off the reagent ion source when it is not in use. As a result, the initial reagent ion beam reaching the separate ion store (in which ETD will occur) has a weakened and delayed response.

Moreover, it is desirable to predict the number of reagent ions, because insufficient reagent ions will result in insufficient fragments, whilst too many reagent ions will lead to charge annihilation, again resulting in insufficient fragments. However, it is difficult to make AGC predictions of the ion current for the first set of ions reaching the ion trap using existing collision cells. It has also been found that the flow of the first set of ions varies significantly, depending on the previous state of the instrument.

Applying a potential gradient to the collision cell such that the electric field experienced by the transmitted ions is uniform and non-zero at all points along the length of the trapping volume allows transmission of the ions at a reliable rate.

In the preferred embodiment, the ions of the first set have a negative charge. It is desirable to transmit negative ions through the collision cell unaffected without having to change the pressure in the collision cell. These ions tend to be more labile than positive ions and therefore the use of high potentials is not recommended. The standard method for overcoming irregularities of the potential in the collision cell (or in this case, transmission cell) is increasing the injection energy. However, this would result in significant loss of negative ions. In particular, ETD anions are specifically designed to give their electron away very easily. This means that these ions could also very easily be stripped in the collision cell, even at moderate energies (such as less than 10 eV). The method of the present invention advantageously addresses this difficulty.

Preferably, this method further comprises: generating the second set of ions; and storing the second set of ions in the separate ion trap. Optionally, the step of generating the second set of ions comprises generating at least one discrete pulse of the second set of ions.

The collision cell preferably has an ion entrance. Then, the step of causing ions to enter the collision cell may occur through the ion entrance in a forward direction and the step of providing a potential gradient comprises causing processed ions to exit the collision cell in this forward direction.

In a further aspect, the present invention may be found in a collision cell, having a longitudinal axis, comprising: an ion entrance, adapted to receive ions entering the collision cell; a first electrode arrangement arranged to generate a trapping field within the collision cell so as to trap received ions within a trapping volume of the collision cell, the trapping volume being defined by the trapping field and extending along the longitudinal axis; a pumping arrangement, arranged to maintain a gas pressure within the collision cell; and a second electrode arrangement, arranged to provide a potential gradient resulting in an electric field of no less than 1 mV/mm at all points along the axial length of the trapping volume so as to cause processed ions to exit the collision cell, the electrode arrangement being further arranged such that the electric field along the axial length of the trapping volume has a standard deviation that is no greater than its mean value.

In another aspect, the present invention may be seen as a mass spectrometer, comprising: an ion source, arranged to generate at least one discrete pulse of a first set of ions, having a first polarity; the gas-filled collision cell defined above; ion optics, configured to direct the pulse or pulses into the collision cell; and an ion trap, arranged to receive the first set of ions from the collision cell and to effect an electron transfer dissociation interaction between the ions of the first set with ions of a second set, the ions of the second set having a second, opposite polarity to those of the said first set.

Preferably, the trapping field is arranged to trap the ions at least radially.

In a further aspect of the invention, a method of analysing proteins is provided comprising the method of operating a gas-filled collision cell in a mass spectrometer described above.

A method of operating a gas-filled collision cell in a mass spectrometer is also conceived. The collision cell has a longitudinal axis and an ion entrance. The method comprises: causing ions to enter the collision cell through the ion entrance in a forward direction; generating a trapping field within the collision cell so as to trap the ions within a trapping volume of the collision cell, the trapping volume being defined by the trapping field and extending along the longitudinal axis; processing trapped ions in the collision cell; and providing a potential gradient, using an electrode arrangement, resulting in a non-zero electric field at all points along the axial length of the trapping volume so as to cause processed ions to exit the collision cell in a reverse direction generally opposed to the said forward direction.

Also conceived is a method of effecting electron transfer dissociation, the method comprising: generating at least one discrete pulse of a first set of ions, having a first polarity, and directing the pulse or pulses into a gas-filled collision cell; generating a trapping field within the collision cell so as to trap the first set of ions within a trapping volume of the collision cell, the trapping volume being defined by the trapping field and extending along the longitudinal axis; providing a potential gradient resulting in a non-zero electric field at all points along the axial length of the trapping volume, so as to cause the first set of ions to be ejected from the collision cell and into a separate ion trap; and effecting an electron transfer dissociation interaction between the ions of the first set in the separate ion trap with ions of a second set, the ions of the second set having a second, opposite polarity to those of the said first set.

BRIEF DESCRIPTION OF THE DRAWINGS

The invention may be put into practice in various ways, a number of which will now be described by way of example only and with reference to the accompanying drawings in which.

SPECIFIC DESCRIPTION OF PREFERRED EMBODIMENTS

Figure 1:
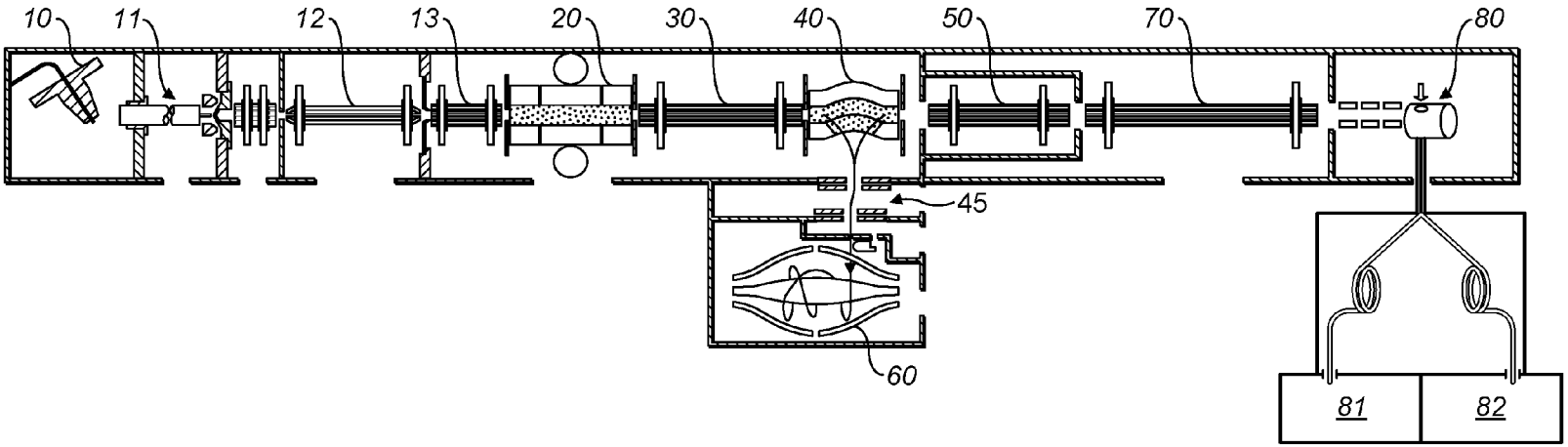
FIG. 1 shows an overview of a first known mass spectrometer.

Referring first to FIG. 1, there is shown an overview of a known mass spectrometer, comprising: an ion source 10; a linear ion trap 20; a transfer multipole ion guide 30; a curved ion trap 40; a High-energy Collision Dissociation (HCD)

collision cell 50; a mass analyser 60; a transfer multipole ion guide 70; and a reagent ion source 80.

Ions are generated in the ion source 10, and ejected towards ion introduction hardware 11, comprising heated capillary, skimmer and lenses. The ions are then guided through multipole ion guide 12 and multipole ion guide 13 to a Linear Ion Trap mass spectrometer 20, which can act as both a mass analyzer and an ion trap. Ions are ejected from the linear ion trap 20 to a transfer multipole ion guide 30, which acts as a quadrupole mass filter and which transfers the ions to a curved trap 40. Vertically below the curved trap 40 is a z-lens 45 and a mass analyser 60, which is this embodiment is an Orbitrap™ mass analyser.

To the right of the curved trap 40 is a HCD collision cell 50. To the right of the collision cell 50 are a second ion transfer multipole 70, and a reagent ion source 80 with first substance inlet 81 and second substance inlet 82.

A first mode of operation, which does not involve the collision cell 50, is described to illustrate the present invention, although it does not form part of it. In this mode, ions are generated in the ion source 10 and then can be "prepared" in the Linear Ion Trap 20, which can include Automatic Gain Control (AGC). These ions are then sent to the curved trap 40, from there orthogonally ejected to the mass analyser 60 and detected in known manner.

In a second mode of operation, the ions are generated and "prepared" as above. The ions are then sent through the curved trap 40, directly to the HCD collision cell 50, in which they are fragmented. The fragmented ions are then returned to the curved trap 40.

The method of returning the fragmented ions to the curved trap 40 is as follows. The collision cell comprises a set of trapping electrodes, which generate an electric field, such that ions can be stored in a trapping volume, defined by this electric field. A potential gradient is applied to the collision cell, such that a non-zero electric field, or a field of at least 1 mV/mm, and which is uniform in nature is experienced by ions across substantially the whole length of the trapping volume. Such a minimum electric field strength can be determined as follows.

This information is provided for the purpose of illustrating the invention and its underlying physics. Detailed discussions of ion mobility, mean free path and collision cross sections can be found in the literature, for example in "Collision Phenomena in Ionized Gases", by Earl W. McDaniel, New York, 1964.

If the ions are polyatomic, for example for a mass spectrometer with a mass range of between 50 and 4000 Da, the ion diameter, ID (in Angstroms), is a function of the ion mass, m:

$$ID = 3 \times e^{\frac{1}{3} ln\left(\frac{m}{6}\right)}.$$

The number of molecules in a unit volume, N, is then given by:

$$N = \frac{P}{kT},$$

where P indicates pressure, T indicates temperature, and k is the Boltzmann constant.

The mean free path for the ions, λ, is given by the following expression:

$$\lambda = 1000 \Big/ \left(\pi \times N \times (0.5 \times BGD + ID) \times 10^{-20} \times \sqrt{1 + \frac{m}{W}}\right),$$

where BGD represents the background molecule diameter and W the molecular weight. In the following examples, the values for pressure are given in mbar.

For example, where Helium is used as collision gas (where BGD=1.4, approximately), possible mean free paths are given in the following table:

| m | ID (Aa) | λ when P = $10^{-3}$ (mm) | λ when P = $3 \times 10^{-4}$ (mm) | λ when P = $10^{-4}$ (mm) |
|---|---|---|---|---|
| 100 | 7.66 | 8.42 | 28.08 | 84.23 |
| 400 | 12.16 | 2.16 | 7.20 | 21.61 |
| 1000 | 16.51 | 0.84 | 2.79 | 8.38 |
| 10000 | 35.57 | 0.07 | 0.23 | 0.69 |

As a second example, where Argon is used as the collision gas (BGD=3.3460), possible mean free paths are given in the following table:

| m | ID (Aa) | λ when P = $10^{-3}$ (mm) | λ when P = $3 \times 10^{-4}$ (mm) | λ when P = $10^{-4}$ (mm) |
|---|---|---|---|---|
| 100 | 7.66 | 23.26 | 77.52 | 232.56 |
| 400 | 12.16 | 6.61 | 22.03 | 66.09 |
| 1000 | 16.51 | 2.62 | 8.74 | 26.23 |
| 10000 | 35.57 | 0.22 | 0.73 | 2.20 |

As a third example, where Nitrogen (air) is used as the collision gas (BGD=3.4173), possible mean free paths are given in the following table:

| m | ID (Aa) | λ when P = $10^{-3}$ (mm) | λ when P = $3 \times 10^{-4}$ (mm) | λ when P = $10^{-4}$ (mm) |
|---|---|---|---|---|
| 100 | 7.66 | 20.09 | 66.96 | 200.88 |
| 400 | 12.16 | 5.56 | 18.52 | 55.55 |
| 1000 | 16.51 | 2.19 | 7.31 | 21.92 |
| 10000 | 35.57 | 0.18 | 0.61 | 1.83 |

Hence, the mean free paths vary between 0.1 and 200 mm, depending on pressure and mass. Accounting for pressure- and mass-dependence, $$\lambda \approx \frac{B}{\sqrt{m}} \times \frac{1}{P},$$

with B varying between 0.05 to 0.5, depending on the nature of the collision gas and the colliding ions.

For an ideal solution, assuming m/z=1000 and P=$3 \times 10^{-4}$, the potential gradient, dU, is given by the following:

$$dU = \frac{kT}{\lambda} \times \frac{1}{q},$$

suggesting between 1 mV/mm and 3 mV/mm to be the minimum desirable potential gradient. The maximal gradient is also related to the mean free path and would be approximately between 1 V/mm and 5 V/mm. In general however, the optimal potential gradient is a function of kT/λ for the specific conditions of the system.

Moreover, the potential gradient is applied to result in a substantially uniform electric field. The uniformity of the electric field can be considered on the basis of two factors: the minimum directional force, which as explained above, may be characterised by a minimum gradient relative to the mean free path; and a maximum exit energy (or spread of exit energies) for the ejected ions, which matches the energy acceptance of the target ion trap. If the exit energy spread is too high (which conversely results when the uniformity of the electric field is insufficient), it is more difficult to trap ejected ions in a subsequent ion store, especially when the ion store is held at a low pressure.

The uniformity of the electric field can be specified statistically, using the standard deviation (or variance) of the distribution along the length of the trapping region. As the standard deviation is reduced, the uniformity of the electric field is increased.

Figure 2:
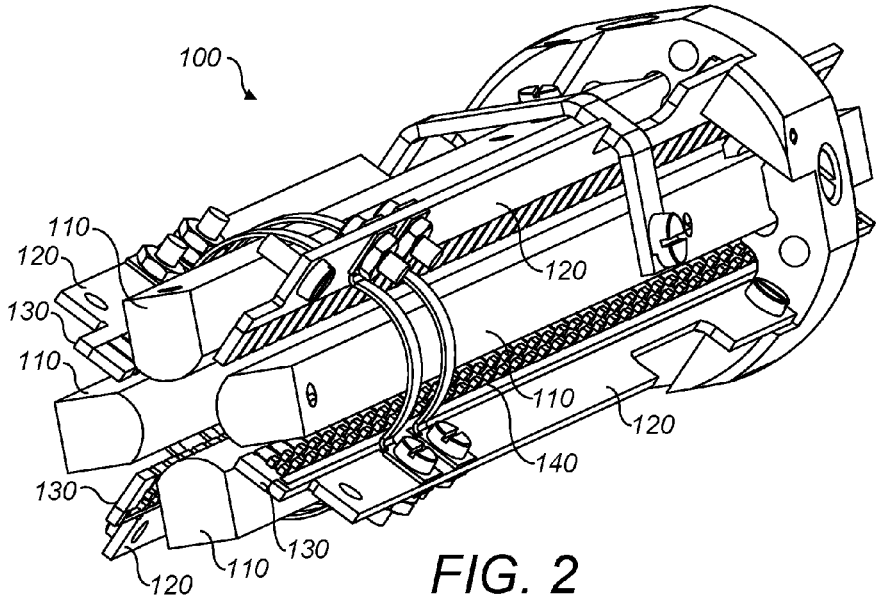
FIG. 2 shows a collision cell for use in the mass spectrometer of FIG. 1 according to the present invention.

Referring now to FIG. 2, there is shown a collision cell 100 according to the present invention. In this collision cell 100, the electric field for ejection of the ions is generated using a printed circuit board (PCB), where metallized areas protrude into a multipole arrangement.

The collision cell comprises: a quadrupole ion guide, comprising a set of substantially parallel rods 110. Between the rods 110, circuit boards 120 are mounted. The face of circuit boards 120 which protrudes towards the ion guide inner volume is cut into segments 130. These segments 130 are interconnected by a resistor chain 140. A voltage gradient is produced by supplying different voltages to the two sides of these PCBs 120 or by supplying a voltage to one side and grounding the other. The cell is contained in a relatively gas-tight enclosure (which is not shown) to maintain the desired pressure.

Referring again to FIG. 1, a third mode of operation of this mass spectrometer can now be described, which uses Electron Transfer Dissociation (ETD). Positive ions are generated in the ion source 10 and stored in the Linear Ion Trap 20 in a known way. Precursor ions are selected in Linear Ion Trap 20 and stored at the Linear Ion Trap 20 at the side closer to the ion source 10. Negative ions are generated in the reagent ion source 80, which is also termed an auxiliary ion source. These ions pass through the HCD collision cell 50 and curved trap 40, and are roughly mass selected in the quadrupole mass filter 30.

From there, they are passed on into the Linear Ion Trap 20. Linear ion trap 20 is set in a "simultaneous positive and negative" trapping mode, for example as described in U.S. Pat. No. 7,026,613 or U.S. Pat. No. 7,145,139. This can be achieved by applying a negative potential well in a first part of the linear ion trap 20, in which the positive ions are stored. In a second part of the linear ion trap 20, a positive potential well is generated, which traps the negative ions.

In the linear ion trap 20, a "fine" mass selection of the reactant anions is performed, and afterwards the anions are allowed to mix with the precursor cations to cause ETD. Afterwards the linear ion trap 20 is switched to a positive ion storage mode, in which a negative potential well is generated. Ions are now detected in the linear ion trap 20, but additionally or alternatively, they may be handed over to the Orbitrap™ mass analyzer 60 for detection in a known way.

Transmission of ions through the HCD collision cell 50 involves collisions of these ions with the neutral gas in the collision cell 50. When ions are transmitted through the collision cell 50 continuously, this collisional damping does not cause a problem, as the space charge of the ions means simply that they will generate an axial field gradient within the collision cell themselves. However, when the ion beam is intermittent, this space charge has to build up first, leading to a delayed response.

Evacuation of the collision cell 50 during transmission of ions is not feasible, since this would reduce the scan speed when switching between modes. Making the flow of ions through the collision cell continuous is also not a practical solution, since this would impede other uses of the collision cell 50, and because maintaining continuous operation of the reagent ion source will reduce its lifetime.

However, applying a potential gradient such that the electric field experienced by the transmitted ions is non-zero along the length of the trap (that is, the electric field is no less than 1 mV/mm at all points along the length of the trapping volume) allows transmission of the ions at a reliable rate.

The direction of the gradient (and the voltage offset of the cell) can be switched to allow alternation between positive ion HCD mode, negative ion HCD mode and ETD mode or auxiliary ion source mode.

Figure 3:
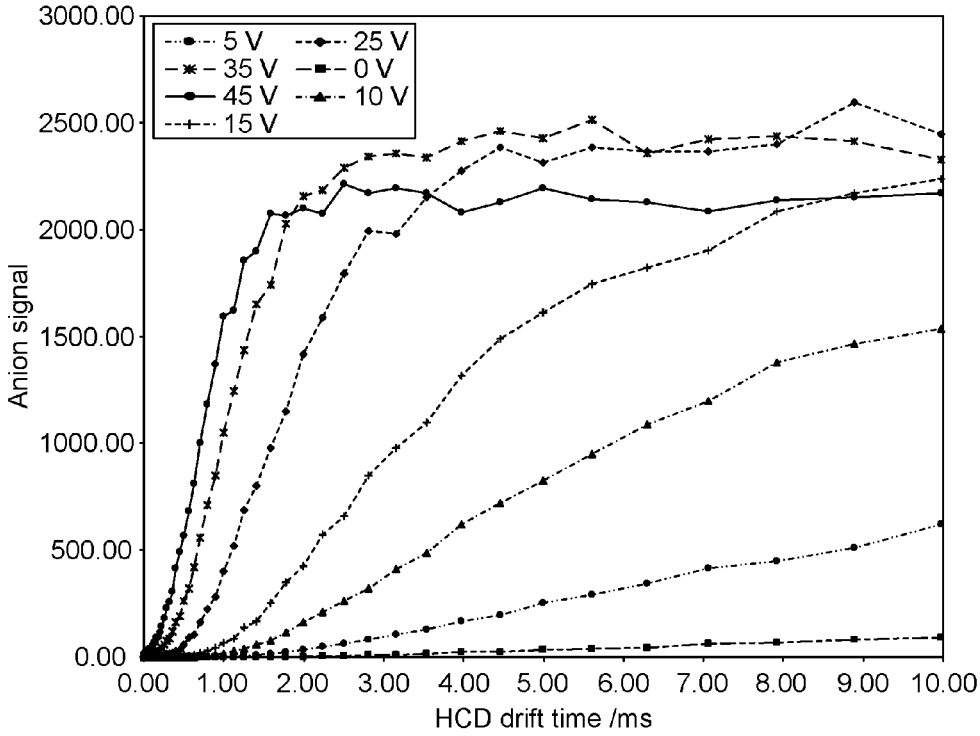
FIG. 3 shows a graph of anion signal against collision cell drift time for the collision cell of FIG. 2.

Referring now to FIG. 3, there is shown a graph of anion signal against collision cell drift time for different potential gradients. The anions were generated in the reagent ion source 80. The collision cell drift time equates to the time required by the anions to traverse the collision cell 50. The drift time required to achieve sufficient anion signal are sufficiently short for nominal voltages of 25V or above.

Figure 4A:
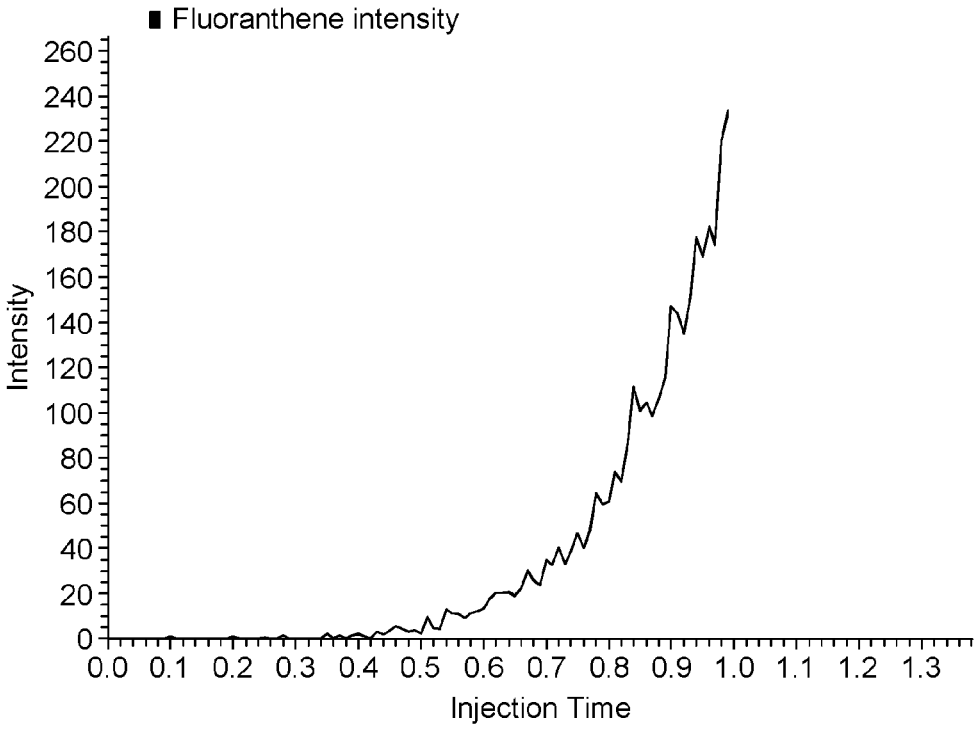
FIG. 4A shows a graph of intensity against injection time for an experiment using a known mass spectrometer.

Referring now to FIG. 4A, there is shown a graph of intensity against injection time for an experiment using a known mass spectrometer, where the electric field at one or more points along the length of the trapping volume of the collision cell is effectively zero, or at least less than 1 mV/mm. The ions used in this experiment were Fluroanthene. It can be seen that the intensity increases non-linearly with respect to injection time. Using this approach, it is therefore difficult to predict the injection time required for a certain quantity of ions. This is a particular problem for the ETD mode of operation.

Figure 4B:
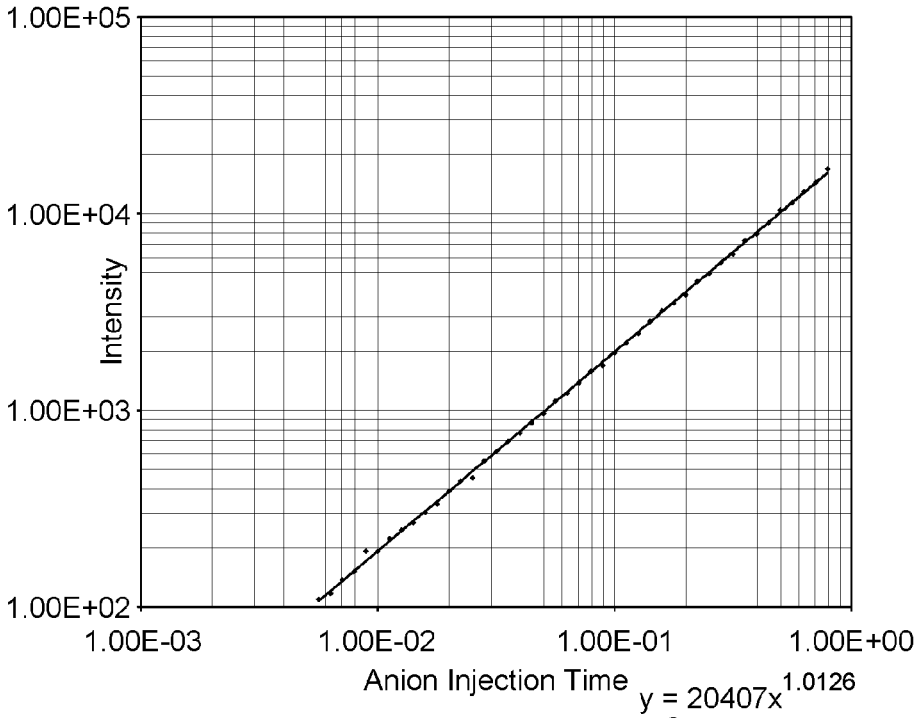
FIG. 4B shows a graph of intensity against injection time for the experiment of FIG. 4A using a mass spectrometer with the collision cell of FIG. 2.

Referring now to FIG. 4B, there is shown a graph of intensity against injection time for the same experiment as for FIG. 4A, where the potential gradient results in an electric field at all points along the length of the trapping volume of the collision cell is non-zero. The ions used in this experiment were Fluroanthene. It can be seen that the intensity now increases linearly with respect to injection time.

Figure 5:
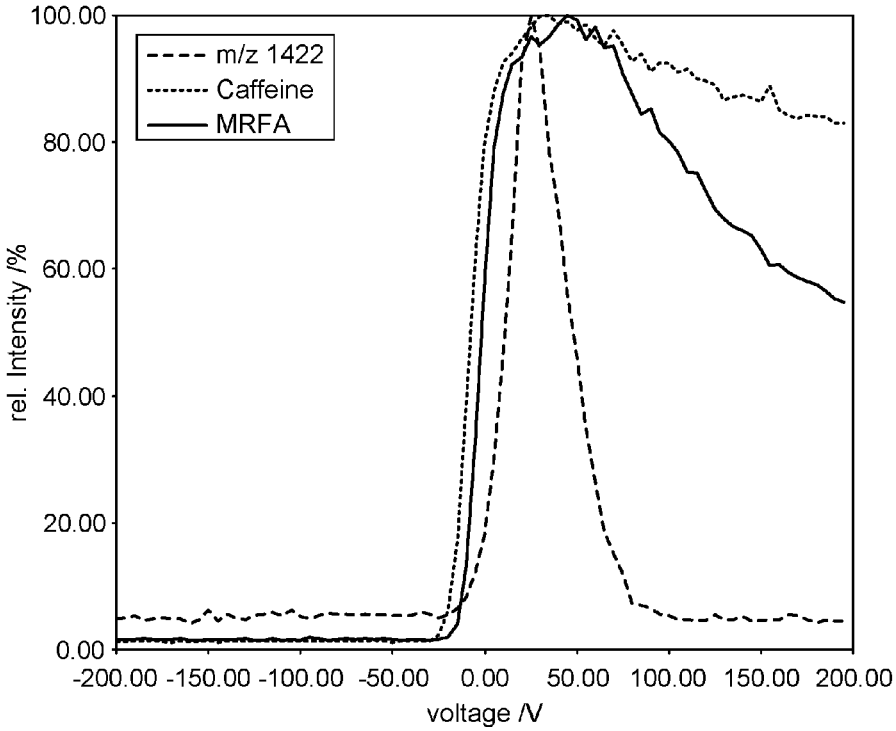
FIG. 5 shows a graph of relative intensity against voltage for experiments using the collision cell of FIG. 2.

Referring now to FIG. 5, there is shown a graph of relative intensity against voltage for a number of different ions. It can be seen that, for each ion, there exists an optimal voltage to maximise the relative intensity of ions ejected from the collision cell.

Whilst a preferred embodiment and operating modes of the present invention have been described above, the skilled person will recognise that the present invention can be implemented in a number of different ways. For example, the skilled person will recognise that the collision cell and method of operating the collision cell may be applied to the mass spectrometers described in U.S. Pat. No. 6,570,153 and U.S. Pat. No. 7,145,133.

$MS^3$, for example, can be implemented in a quadrupole Time Of Flight mass spectrometer (TOF-MS), using the present invention, in the following way. Ions are generated in an ion source, mass selected in a first mass filter, directed into the collision cell and fragmented. Afterwards they are redirected by the application of a potential gradient thereby realising a non-zero electric field at all points along the length of the trapping volume, as described above. In the first mass filter, another mass is then selected from the fragments and re-injected into the collision cell to fragment again and thus produce $MS^3$ fragment ions. These are than directed into a TOF mass analyzer for mass analysis.

In an alternative embodiment, ions from the ion source are mass selected in a first mass filter, fragmented in the collision cell, and then allowed to pass into a second mass filter or linear ion trap mass analyzer, where another mass selection takes place. The ions are subsequently transferred back through the collision cell to the first mass filter. Performance of this redirection is enhanced by having an electrical field in the collision cell that forces the ions upstream. The non-zero electric field at all points along the length of the trapping volume is preferable.

Optionally, another mass selection takes place and the ions are sent downstream again. To achieve this, the electric field in the collision cell is advantageously but not necessarily oriented such that the ions are assisted downstream. Following this, the ions are either mass analyzed and detected by the second mass filter or directed to an additional mass analyzer such as an orbirtrap-type mass analyser or TOF mass analyser.

Figure 6:
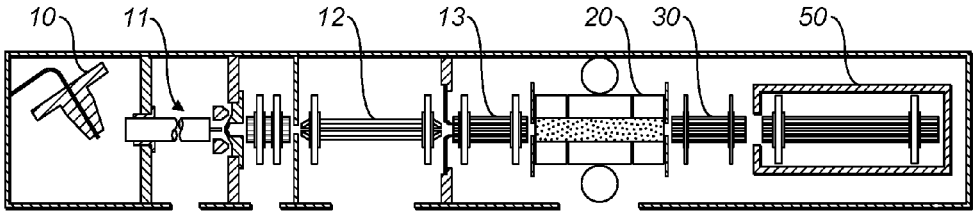
FIG. 6 shows an overview of a second mass spectrometer, which can use a collision cell according to the present invention.

Referring now to FIG. 6, there is shown an overview of a second mass spectrometer, which can use a collision cell according to the present invention. Where the same components as shown in FIG. 1 are shown, identical reference numerals have been used. The skilled person will recognise that the mass spectrometer shown in FIG. 6 differs from that shown in FIG. 1, in that no reagent ion source or associated ion optics is included. Also, the mass spectrometer comprises only a single mass analyser, linear ion trap 20 and does not comprise a second mass analyser or a curved trap for ejection of ions thereto. A potential gradient is applied to the collision cell 50, as described above, such that a non-zero electric field is generated at all points along the length of the trapping volume of the collision cell 50. This may be implemented, for example, as shown in the embodiment of FIG. 2.

An exemplary method of operation for the mass spectrometer of FIG. 6 is now described. Precursor ions are selected in the linear ion trap 20, sent into the collision cell 50, where reaction, including fragmentation, takes place. The fragments, reaction products and possibly precursor ions are then ejected from the collision cell 50 using the generated axial gradient.

The skilled person will recognise that the multipole ion guide 30, shown as located between linear ion trap 20 and collision cell 50 is optional. In this preferred embodiment, it could, for example, be used to manage pressure or gas type incompatibilities, since a linear ion trap is usually operated with helium, whereas collision cells are frequently advantageously operated with nitrogen. Moreover, collision cells can be operated at a higher pressure than linear ion traps. When the higher pressure or the different gas in the collision cell leaks over to the linear ion trap, this would have adverse effects on the mass analyzing capabilities of the trap.

Figure 7:
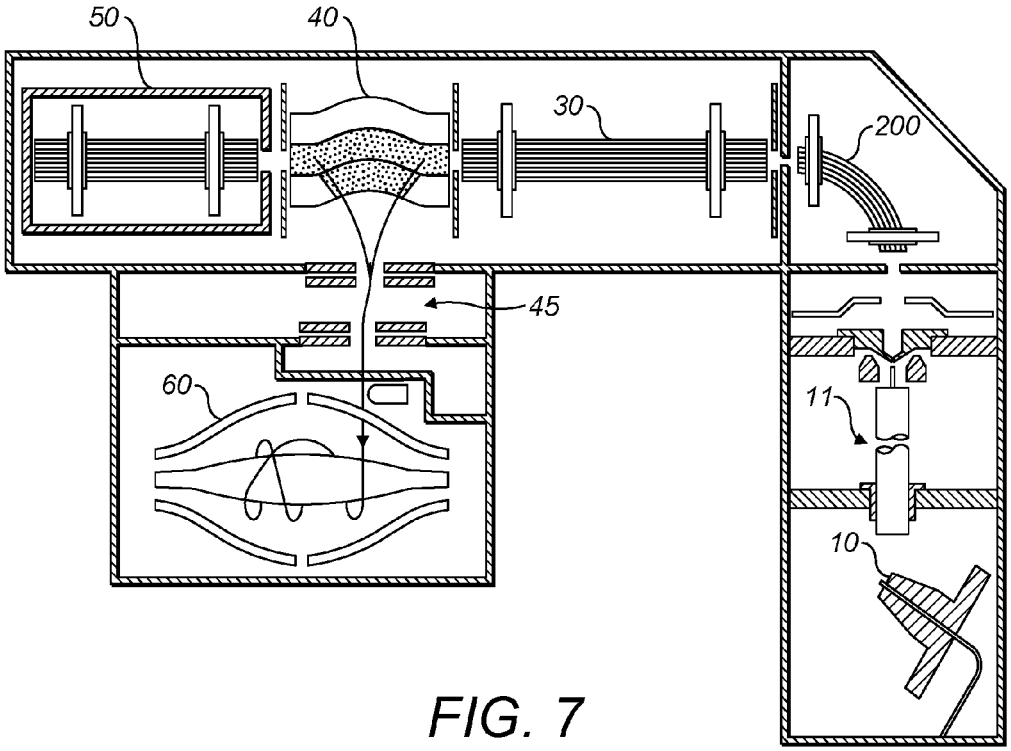
FIG. 7 shows an overview of a third mass spectrometer, which can use a collision cell according to the present invention.

Referring now to FIG. 7, there is shown an overview of a third mass spectrometer, which can use a collision cell according to the present invention. Where the same components as shown in FIG. 1 are shown, identical reference numerals have been used.

The mass spectrometer comprises: an ion source 10; a multipole ion guide 200; a curved trap 40; a collision cell 50; and a mass analyzer 60 upstream of the collision cell 50. Again, a potential gradient is applied to the collision cell 50, as described above, such that a non-zero electric field is generated at all points along the length of the trapping volume of the collision cell 50.

Ions are generated in the ion source 10 and transmitted through the ion guiding means 11, multipole ion guide 200 and multipole ion guide 30, allowing ions to enter and exit the ion trap 40, with or without intermediate storage. The ions are then accelerated into the collision cell 50. Here the ions are allowed to fragment or react.

After injection of the ions into the collision cell 50, the offset to the electrodes of the collision cell 50 is raised, such that the ions in the cell are energetically lifted to a different potential energy.

Afterwards ions are led out back into the ion store 40, assisted by the gradient established along collision cell 50. Finally ions are sent through a differential pumping and deflection stage 45 to the mass analyzer 60. Although, FIG. 6 shows the mass analyser 60 as an Orbitrap™ mass analyzer, it could alternatively be any other ion trapping analyzer, a TOF-MS or a multi-reflection TOF-MS.

The skilled person will recognise that a further mass selective element might be provided upstream of the collision cell 50 to allow faster $MS^n$ operation.

Figure 8A:
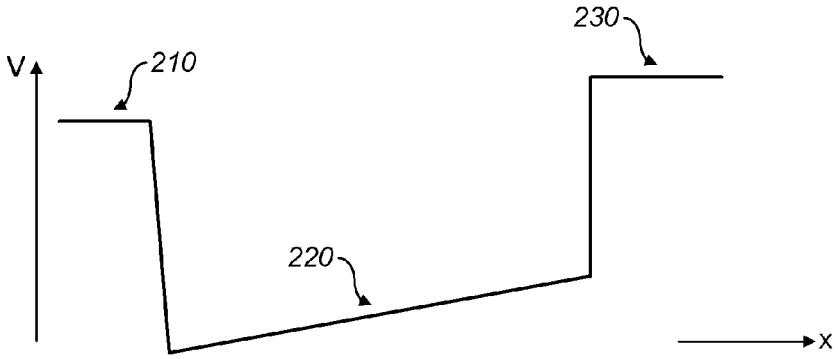
FIG. 8A illustrates a potential along the length of a collision cell according to the present invention when ions are entering the collision cell.

Referring now to FIG. 8A, there is illustrated a potential along the length of a collision cell according to the present invention when ions are entering the collision cell. In region 210 and region 230, which are external to the collision cell, the potential is maintained at a high level. In region 220, within the collision cell, the potential is much lower than in region 210 and in region 230, such that potential barriers are formed. Nevertheless, the potential in region 220 has a gradient of increasing potential from region 210 to region 220.

Ions enter the collision cell from region 210, which is usually an ion trap, such as curved ion trap 40. The collision energy is selected by the energy offset between the ion trap and the collision cell.

In the collision cell, ions undergo collisions with the cooling gas, resulting in energy loss. During injection of ions into the collision cell, the direction of the potential gradient within region 220 is of negligible effect, since the energy difference between the ions and the potential is high.

A potential barrier at (or optionally past) the end of the collision cell, at the start of region 230 ensures that ions will return and continue their travel in the reverse direction from the direction in which they entered the collision cell. The returning ions will then be stopped at the border between collision cell and ion trap at region 210 due to the potential barrier there, particularly as they have now lost energy due to collisional cooling.

Figure 8B:
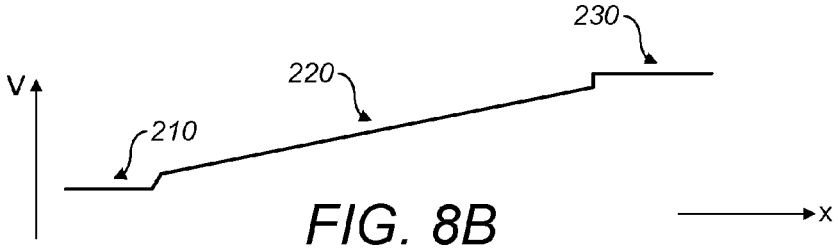
FIG. 8B illustrates a potential along the length of the collision cell when ions are ejected from the collision cell.

Referring now to FIG. 8B, there is illustrated a potential along the length of the collision cell when ions are ejected from the collision cell. Since the same regions as referred to in FIG. 8A are shown, the same reference numerals are used.

At any convenient time after ion injection, preferably immediately after all ions entered the collision cell, the relative potentials are switched to the settings shown in FIG. 8B, such that the potential barriers are reduced. Here, the direction and slope of the potential gradient (or equivalently, the direction and strength of the electric field) have a significant effect, causing the ions to move towards region 210. These are the conveniently same as for FIG. 8A. No change to the potential gradient is made.

The ions are gently ejected into the ion trap in region 210, where they undergo fewer collisions in comparison with injection. The parameters of the collision cell gradient are therefore significant. FIG. 8B may also illustrate a potential when transmission of negative ions from region 230 to region 210 is desired.

Whilst specific embodiments have been described herein, the skilled person may contemplate various modifications and substitutions. For example, the skilled person will recognise that axial potential gradients according to the present invention can be generated in other ways than that shown in FIG. 2. Methods for establishing an axial potential gradient can be found in U.S. Pat. No. 5,847,386 and U.S. Pat. No. 7,067,802, for example. The skilled person will understand that careful control of the potentials applied is desirable to achieve the desirable electric field specified by the present invention.

The skilled person will also appreciate that ions entering the collision cell in the forward direction may first exit the collision in another direction. For example, the collision cell may comprise a further aperture other than the ion entrance, through which the ions exit the collision cell in the forward direction. The ions' direction of travel may then be reversed outside of the collision cell. These ions can then re-enter the collision cell through the further aperture, or through another aperture, and exit the collision in the reverse direction as a result of the non-zero electric field at all points along the axial length of the trapping volume.

In an alternative embodiment of the third mode of operation described above (relating to Electron Transfer Dissociation), ions are guided through the quadrupole mass filter 30, with the high mass cut-off set to just above the mass of the ETD agent ion. The target trap is then set to eject ions of lower mass, thus acting as a "high-pass" filter.

The invention claimed is:

1. A method of operating a gas-filled collision cell in a mass spectrometer, the collision cell having a longitudinal axis extending between a first end and a second end, the method comprising:

causing ions to enter the collision cell through the first end in a forward direction;

generating a trapping field within the collision cell so as to trap the ions within a trapping volume of the collision cell, the trapping volume being defined by the trapping field and extending along the longitudinal axis;

ejecting trapped ions from the collision cell in the forward direction through the second end;

causing the ejected ions to re-enter the collision cell in the reverse direction through the second end; and ejecting ions from the collision cell in a reverse direction through the first end, wherein the method further comprises providing a DC potential gradient, using an electrode arrangement, resulting in a non-zero electric field at all points along the axial length of the trapping volume so as to cause ions to exit the collision cell in the reverse direction, wherein the direction and magnitude of the DC potential gradient remains the same during the steps of generating the trapping field, and ejecting ions in the reverse direction.

2. The method of claim 1, further comprising a step of processing the ions.

3. The method of claim 2, wherein the step of processing the ions includes processing the ions within the collision cell prior to ejecting the ions from the collision cell in the forward direction.

4. The method of claim 2, wherein the step of processing the ions includes processing the ions outside of the collision cell subsequent to ejecting the ions from the collision cell in the forward direction.

5. The method of claim 2, wherein the step of processing the ions includes fragmenting the ions.

6. The method of claim 1, further comprising a step of mass selecting ions prior to causing ions to enter the collision cell in a forward direction.

7. The method of claim 1, further comprising a step of trapping ions that re-enter the collision cell in the reverse direction.

8. The method of claim 1, wherein the step of ejecting ions from the collision cell in the reverse direction includes reducing a potential harrier at or proximate to the first end.

9. The method of claim 8, wherein the step of reducing the potential barrier includes increasing a potential energy of ions confined within the trapping volume.

10. The method of claim 1, wherein the DC potential gradient results in an electric field of no less than 1 V/m at any point along the longitudinal extent of the trapping volume.

11. The method of claim 1, wherein the trapping volume is filled with collision gas, and the product of the pressure of the collision gas and the longitudinal extent of the trapping volume is no greater than 0.004 mbar·cm.

12. The method of claim 1, further comprising:

generating ions in an ion source; and causing the generated ions to enter and then exit an ion store before the step of causing ions to enter the collision cell through the first end in a forward direction.

* * * * *